US006336016B1

(12) United States Patent
Ikeda

(10) Patent No.: US 6,336,016 B1
(45) Date of Patent: Jan. 1, 2002

(54) IMAGE FORMING APPARATUS AND IMAGE FORMING METHOD

(75) Inventor: Wataru Ikeda, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/708,412

(22) Filed: Nov. 9, 2000

(51) Int. Cl.[7] ..... G03G 15/00

(52) U.S. Cl. ..... 399/107; 399/124; 399/405; 399/407

(58) Field of Search ..... 399/107, 124, 399/388, 391, 393, 405, 407; 271/278, 279, 306, 184, 185

(56) References Cited

U.S. PATENT DOCUMENTS 6,263,185 B1 * 7/2001 Kato et al. ..... 399/407 X

FOREIGN PATENT DOCUMENTS

JP 406016255 * 1/1994
JP 406048593 * 2/1994
JP 7-267482 10/1995

* cited by examiner

*Primary Examiner*—Sophia S. Chen
*Assistant Examiner*—Hoan Tran
(74) *Attorney, Agent, or Firm*—Foley & Lardner

(57) ABSTRACT

An image forming apparatus according to the present invention includes a paper feed cassette that holds a record medium vertically, and paper feed rollers that feed the record medium in the paper feed cassette to image forming direction while holding the record medium vertically, and a developed image forming portion that forms a developed image onto the record medium while the record medium is fed from the paper feed cassette and held and transferred vertically, and a sorter that sorts the record media discharged from the developed image forming portion for respective users and collects the record media vertically into plural sorter bins, and a flat panel that incorporates at least the paper feed cassette, the developed image forming portion, and the sorter into a vertical flat plane as a body. And further, the panel is arranged vertically in space, and at necessity functions as a partition to separate the space.

25 Claims, 13 Drawing Sheets

IMAGE FORMING APPARATUS AND IMAGE FORMING METHOD

BACKGROUND OF THE INVENTION

1. Field of the Invention

The present invention relates to a multifunction image forming apparatus having a developed image forming portion to be shared by a copier, printer, facsimile and so forth, and an image forming method thereof.

2. Description of the Related Art

In the art of electronic photo type image forming apparatus, now toward practical applications is an image forming apparatus called Multifunction Peripheral having a developed image forming portion to be shared by plural image forming apparatus that are incorporated therein and have different functions such as a copier, printer, facsimile and so forth (hereinafter referred to as MFP).

This MFP, that incorporates plural image forming functions of a copier, printer, facsimile and so forth as a single image forming apparatus, is already publicly known to those skilled in the art.

In such an MFP, irrespectively of plural image forming functions, a large size sorter is generally arranged so as to sort output paper sheets after forming images, in order to increase its image forming efficiency. And since such an MFP is operated by plural users in various manners, developed is such MFP as conventionally disclosed in the Japanese Patent Publication No.7-267482, which is equipped with a sorter where users place output paper sheets into sorter bins for their respective purposes in advance, thereby they can get their respective output paper sheets in a swift manner without hesitation.

In the MFP, however, it has been necessary to arrange a special base for its operation or to install it directly onto floor, therefore, it has been required to secure installation space exclusive for such an MFP. And further so as to increase image forming efficiency in various functions, such an MFP is equipped with a large size sorter, which in turn requires wider installation space, in this way, the installation of an MFP has deteriorated space saving property in offices.

While, in offices and so forth where MFP's are used, flat plate shaped partitions to easily partition office space are generally arranged so as to separate working areas from passages. These partitions have a large area of flat sections so that they hide working areas from people passing through passages.

However, in the prior art, the flat sections of partitions have failed to be made effective for other purposes than blindfold.

Accordingly, expected in offices and so on is an effective utilization of the wide flat sections of partitions. And in offices and so forth using MFP's, there is a demand for space saving in installation space for MFP's, and also expected is a development of an highly operational MFP that enables plural users to use one in a convenient manner.

SUMMARY OF THE INVENTION

Accordingly, it is an object of the present invention to save installation space for MFP in offices and so forth.

Another object of the present invention is to improve convenience in which users may get output paper sheets for their respective functional purposes in a swift manner without hesitation, and may handle output paper sheets.

Still further object of the present invention is to make the most of wide flat sections of partitions to be arranged in offices.

According to the present invention, it is possible to provide an image forming apparatus comprising a holder configured to hold a record medium vertically; a feeder configured to feed the record medium in the holder to image forming direction in a vertically held status; a printer configured to form a developed image onto the record medium in accordance with image information while the record medium fed from the holder goes through in vertically held status; a sorter configured to sort the record media discharged from the printer for respective users and collect the record media vertically into plural sorter bins; and a frame configured to incorporate at least the holder, the printer, and the sorter into one body in vertically flat shape.

Further, according to the present invention, it is possible to provide an image forming apparatus comprising a paper feed cassette configured to hold a record medium vertically; a paper feed roller configured to feed the record medium in the paper feed cassette to image forming direction in a vertically held status; a developed image forming portion configured to form a developed image onto the record medium in accordance with image information while the record medium fed from the holder goes through in vertically held status; a sorter configured to sort the record media discharged from the developed image forming portion for respective users and collect the record media vertically into plural sorter bins; and a panel configured to incorporate at least the paper feed cassette, the developed image forming portion, and the sorter into one body in vertically flat shape.

Still further, according to the present invention, it is possible to provide an image forming method comprising the steps of assembling a paper feed cassette configured to hold a record medium vertically, a developed image forming portion configured to form a developed image onto the record medium fed from the paper feed cassette in accordance with image information, and a sorter configured to sort the record media discharged from the developed image forming portion for respective users and collect the record media vertically into plural sorter bins into a flat panel as one body so that the discharge end of the record media should meet the input end of the record media; forming the developed image onto the record media in a status where the record media are held vertically; and collecting the record media into the plural sorter bins for respective users.

DESCRIPTION OF THE PREFERRED EMBODIMENTS

The invention is illustrated in more details by reference to the following referential examples and preferred embodiments wherein.

Figure 1:
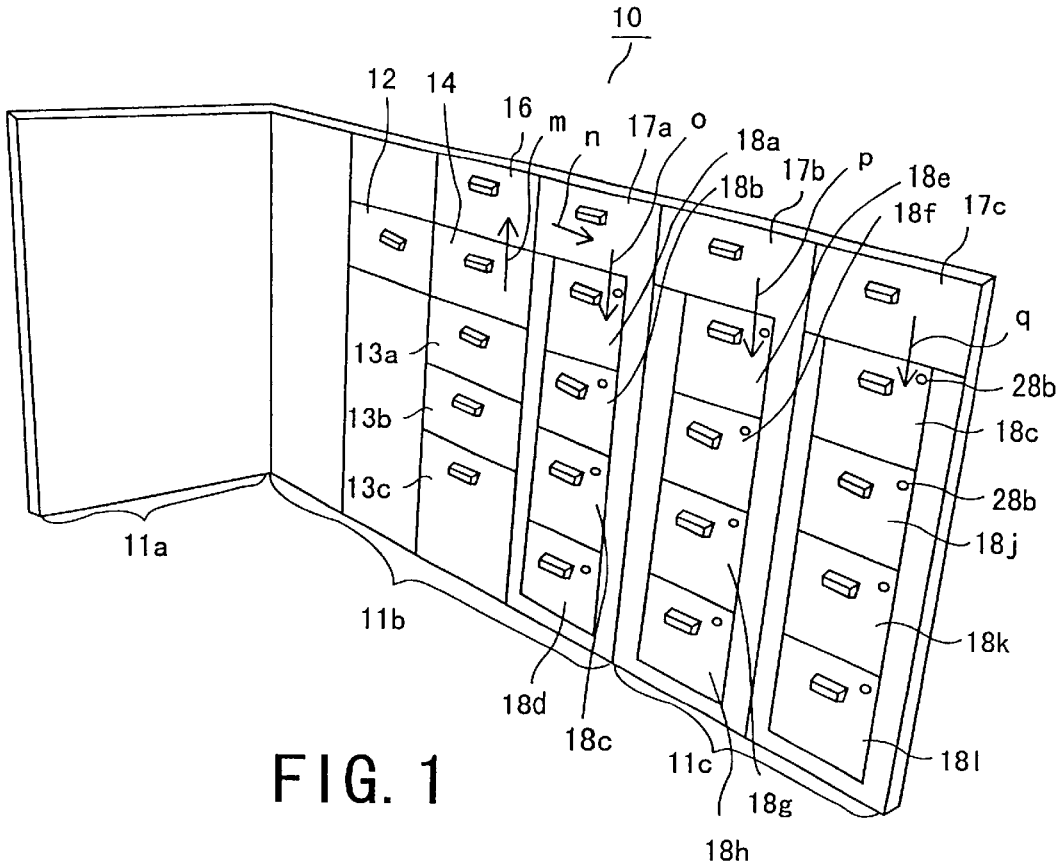
FIG. 1 is a schematic diagonal view of an MFP according to one preferred embodiment of the present invention.
Figure 2:
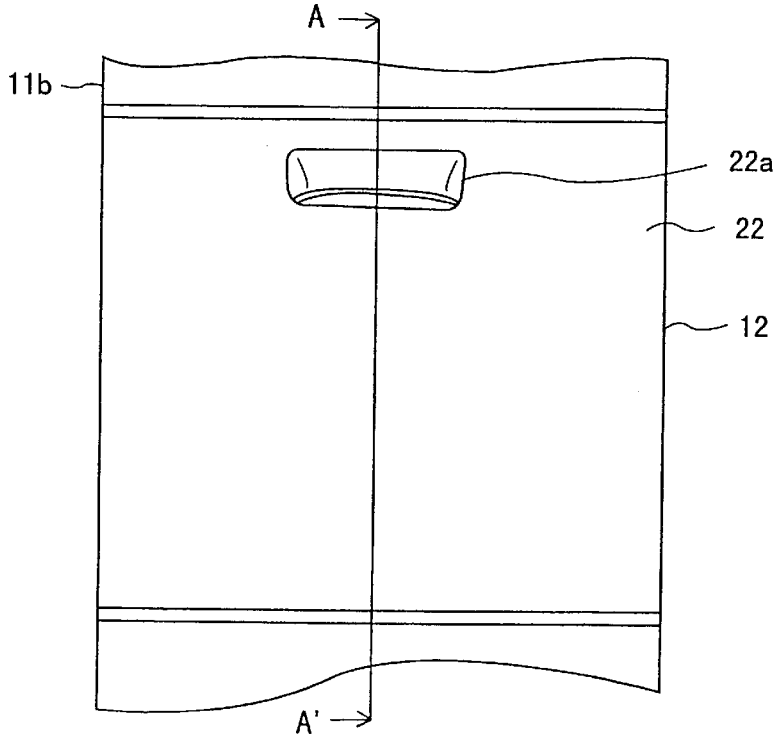
FIG. 2 is a schematic frontal view of a document reading portion according to one preferred embodiment of the present invention.
Figure 3:
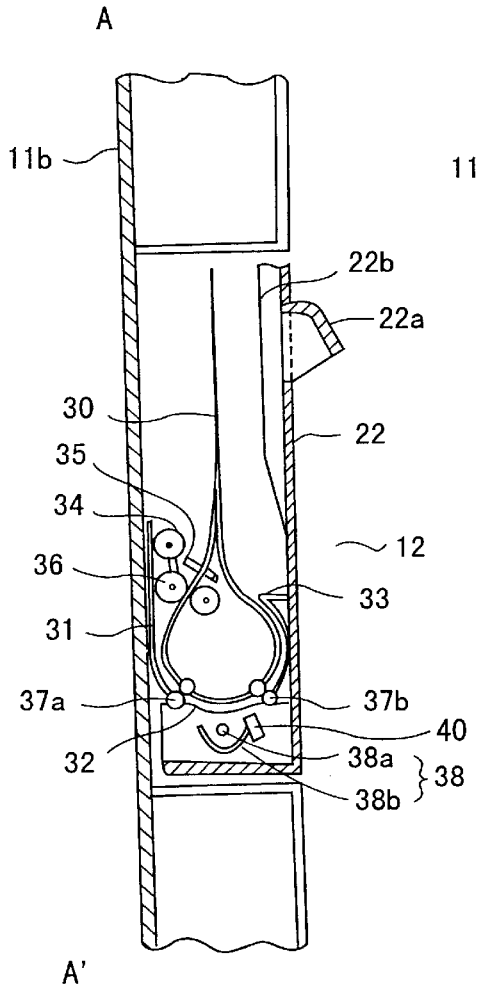
FIG. 3 is a schematic explanatory diagram showing a cross section of a document reading portion according to one preferred embodiment of the present invention, viewed at the line A–A' in FIG. 2.

FIG. 1 is a schematic diagonal view of one preferred embodiment according to the present invention, showing an MFP 10 as an image forming apparatus incorporating an electronic photo type copier, printer and facsimile functions in a single unit. This MFP 10 is incorporated into a second and third partitions 11*b* and 11*c*, with a first to third plate type partitions 11*a* to 11*c* that are panels that conventionally separate sections, passages and so forth in offices and so on as its installation means.

Namely, assembled into the second partition 11*b* are a first to third paper feed cassettes 13*a* to 13*c* that hold a document reading portion 12 and paper sheet P as record media. Further assembled into the second partition 11*b* are a developed image forming portion 14 that forms a development image in accordance with image information output from the document reading portion 12 or image information output from a computer or facsimile image information sent from a communication line, and a first transfer direction change portion 16 that configures a transfer direction change portion.

Still further assembled into the second partition 11*b* are a first reversing portion 17*a* as a second transfer direction change portion to configure a transfer direction change portion, and a first to fourth sorters 18*a* to 18*d* that sort output paper sheets P on which images have been formed by the developed image forming portion 14 and collect them vertically.

While, assembled into the third partition 11*c* are a second and third reversing portions 17*b* and 17*c* as a second transfer direction change portion, and a fifth to twelfth sorters 18*e* to 18*l* that sort output paper sheets P on which images have been formed and collect them vertically.

The document reading portion 12, the first to third paper feed cassettes 13*a* to 13*c*, the developed image forming portion 14, the first transfer direction change portion 16, the first to third reversing portion 17*a* to 17*c*, the first to the twelfth sorters 18*a* to 18*l* that are assembled into these second and third partitions 11*b* and 11*c* are so assembled that their frontal cover portions 22, 23, 24, 26, 27 and 28 should be flat with the front sides of the second or third partition 11*b* or 11*c* in normal conditions including conditions for image formation.

And all the cover portions 22, 23, 24, 26, 27 and 28 may be opened and closed at taking out paper sheets P or at maintenance work, by pulling their knobs 22*a*, 23*a*, 24*a*, 26*a*, 27*a* and 28*a*, and turning them to the front sides of the second or third partition 11*b* or 11*c*.

MFP 10 assembled into the second and third partitions 11*b* and 11*c* in the manner mentioned above, at image forming operation, output paper sheets P through the arrow direction m and the arrow direction n, in the arrow direction o, p or q.

The document reading portion 12 has a first transfer guide 30 that conveys sheet shape document G while holding document vertically, and also has a second to fourth transfer guides 31 to 33 that guide the reverse rotation of document G by a first and second transfer rollers 37*a* and 37*b* around the first transfer guide 30. At the paper feed side of the first transfer guide 30, arranged are a paper feed sensor 35 that detects document G, a pickup roller 34 that takes in document G, and a separate roller 36 that conveys document G one by one separately.

At the position facing against the first transfer guide 30 between the first transfer roller 37*a* and the second transfer roller 37*b*, arranged are a radiation device 38 comprising a lamp 38*a* and a reflection plate 38*b*, and a reading sensor 40 that detects reflected light from document G radiated by the radiation device 38. And inside of the cover portion 22 of the document reading portion 12, formed is a waste paper tray 22*b*.

Figure 4:
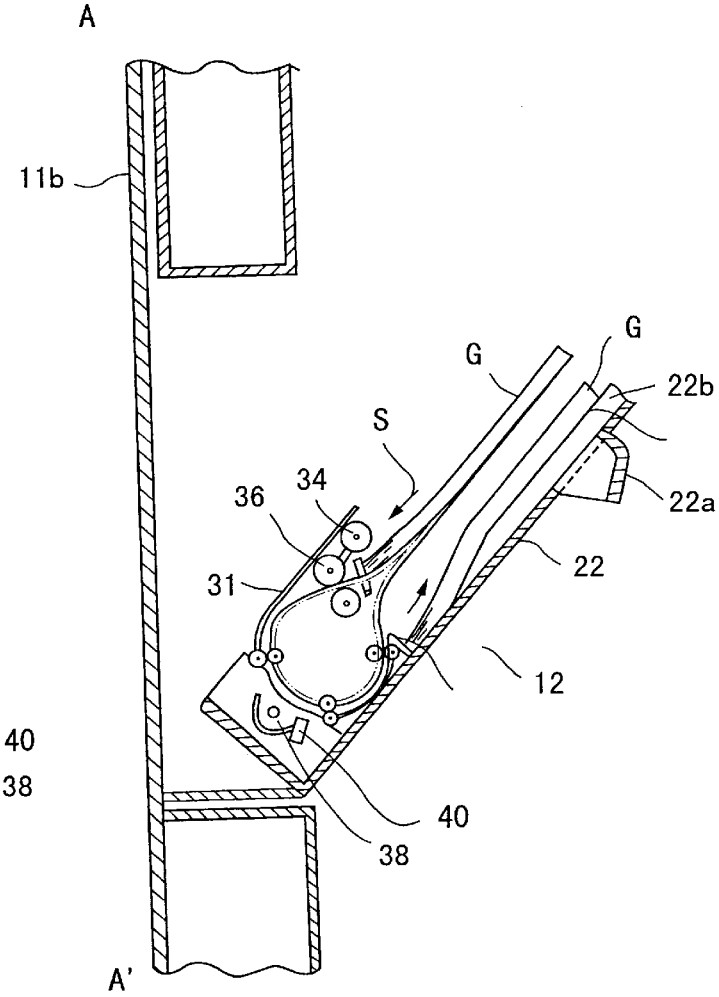
FIG. 4 is a schematic explanatory diagram showing a cross section of a document reading portion according to one preferred embodiment of the present invention shown in FIG. 3, opened to the frontal side of a partition.
Figure 5:
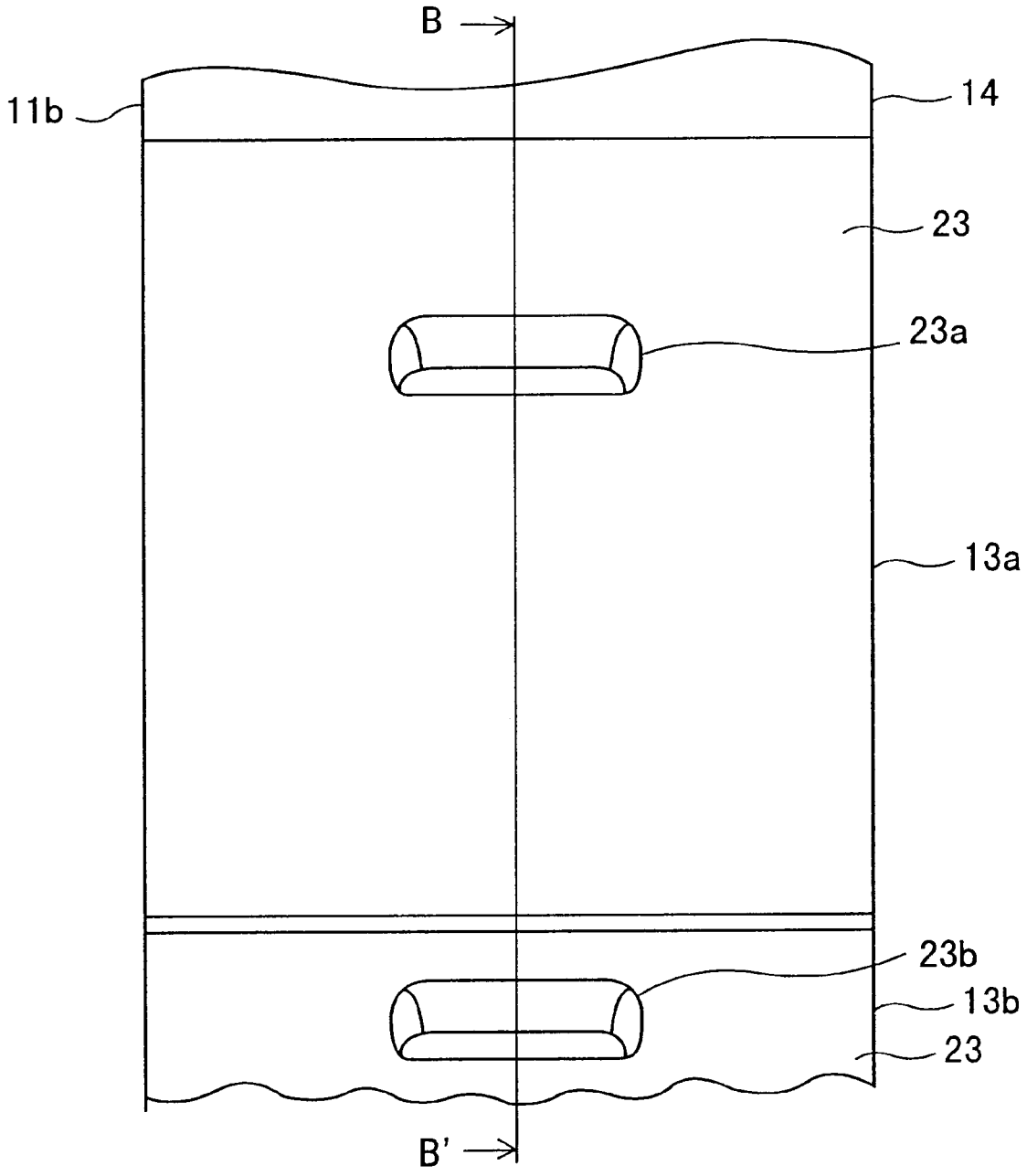
FIG. 5 is a schematic frontal view of a paper feed cassette according to one preferred embodiment of the present invention.

When to read document G for copying operation, an operator pulls the knob 22*a* formed on the cover portion 22, and turns the document reading portion 12 to the front side of the second partition 11*b* as shown in FIG. 4, and sets document G to the paper feed side of the first transfer guide 30. When the paper feed sensor 35 detects document G and document reading operation starts, the pickup roller 34, the separate roller 36, and the first and second transfer rollers 37*a* and 37*b* are driven, thereby document G is conveyed in the arrow direction s. Further after reading document image information by the radiation device 38 and the reading sensor 40, the document G is discharged into the waste paper tray 22*b*.

Each of the paper feed cassettes 13*a* to 13*c* is equipped with a paper feed unit 40 for supplying various sizes of paper sheets P for example in B5, A4, A3 and other sizes to the arrow direction m in the direction of the developed image forming portion 14 while holding paper sheets vertically. The paper feed unit in turn is equipped with a rib 41, a press roller 42 for holding paper sheets P vertically, a pickup roller 43 for taking out paper sheets P at the highest stage, and a separate roller 44 for separately conveying paper sheets P one after another.

At the rear sides of the first and second paper feed cassettes 13*a* and 13*b*, formed is a transfer route 47 that has a transmission roller 46 for transmitting paper sheets P taken out from the second and third paper feed cassettes 13*b* and 13*c* at lower stage to the developed image forming portion 14. And the first paper feed cassette 13*a* has an adjusting guide 48 for guiding paper sheets P to the paper sheet input end of the developed image forming portion 14 at the top thereof.

When developed image forming operation starts, at optional paper feed cassettes 13*a* to 13*c*, the pickup roller 43 and the separate roller 44 are driven in accordance with the image forming timing of the developed image forming portion 14, and thereby paper sheets P are taken out in the direction of the developed image forming portion 14. If paper sheets P are taken out from the second and third paper feed cassettes 13*b* and 13*c*, paper sheets P are supplied to the developed image forming portion 14 through the transfer route 47 and then through the adjusting guide 48, while if paper sheets P are taken out from the first paper feed cassette 13*a*, paper sheets P are supplied to the developed image forming portion 14 directly through the adjusting guide 48.

Figure 7:
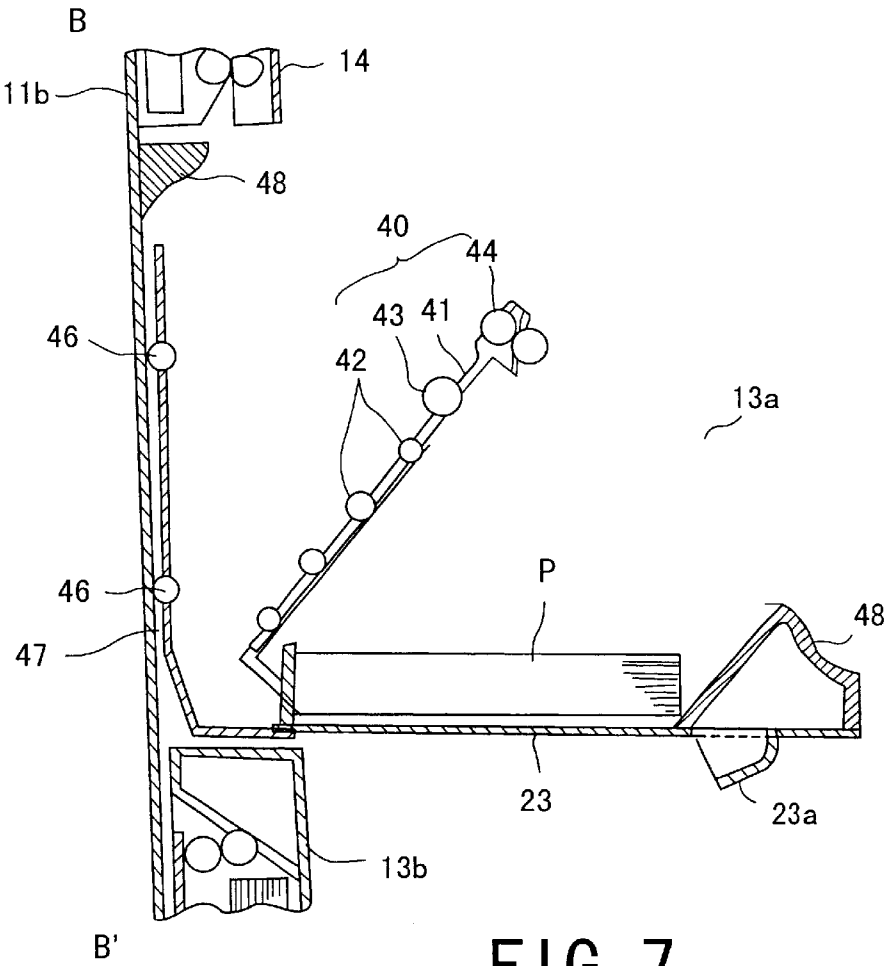
FIG. 7 is a schematic explanatory diagram showing a cross section of a paper feed cassette according to one preferred embodiment of the present invention shown in FIG. 6, opened to the frontal side of a partition.
Figure 6:
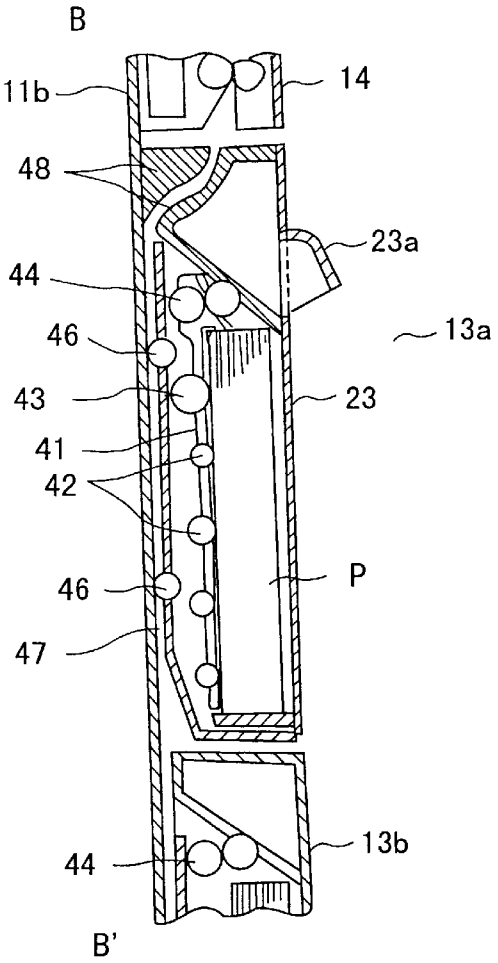
FIG. 6 is a schematic frontal view of a paper feed cassette according to one preferred embodiment of the present invention, viewed at the line B–B' in FIG. 5.
Figure 8:
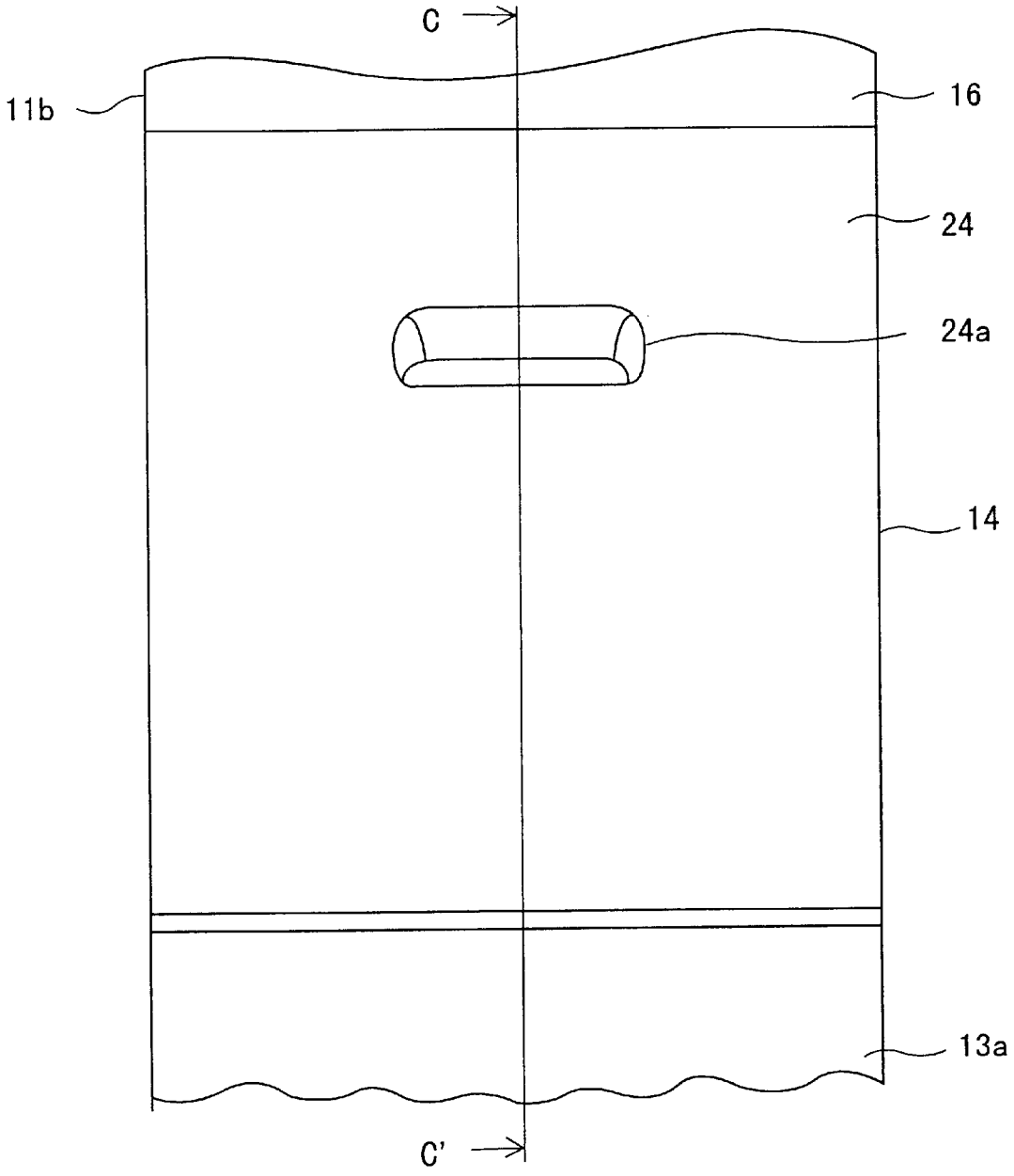
FIG. 8 is a schematic frontal view of a developed image forming portion according to one preferred embodiment of the present invention.

And when to replenish paper sheets P, as shown in FIG. 7, an operator pulls the knob 23*a*, and turns the specified paper feed cassettes 13*a* to 13*c* until they become level at the front side of the second partition 11*b*, and further lifts up the rib 41 and then replenishes paper sheets P. After then, an operator sets the rib 41 onto the paper sheets P, and resets the paper feed cassettes 13*a* to 13*c* so that they get flat with the front side of the second partition 11*b*.

In the next place, the developed image forming portion 14 has a photosensitive drum 50. Around the photosensitive drum 50, arranged in the rotating direction in the arrow direction t of the photosensitive drum 50 are an electrification charger 51, an exposure portion 53 of an exposure device 52 that convert document image information read by the document reading portion 12, facsimile image information sent via communication line (not illustrated herein), or image information output from a computer (not illustrated herein) into optical signal, a developing device 54, a transfer conveyor belt 56, a release nail 57, a cleaning device 58 and an electricity removing lamp 60.

Further, at the upstream side from the photosensitive drum 50 of the developed image forming portion 14, formed is a guide 63 for conveying paper sheets P vertically by a transfer roller 61 and a resist roller 62, while at the downstream side from the transfer conveyor belt 56 of the developed image forming portion 14, arranged are a fixation roller coupling 64 and paper discharge roller coupling 66. And at the downstream side of the paper discharge roller coupling 66, formed is an adjusting guide 67 for guiding paper sheets P to the paper sheet input end of the first transfer direction change portion 16.

At the start of developed image forming operation, the photosensitive drum 50 is made to carry out developed image forming process orderly in accordance with the rotation in the arrow direction t, and first it is charged uniformly by the electrification charger 51. Then exposure operation is carried out on this uniformly charged photosensitive drum 50 by the exposure device 52, and a latent image is formed on the photosensitive drum 50 by optical signal converted from document image information, facsimile image information or computer output image information. After then, the photosensitive drum 50 is developed by the developing device 54, thereby a toner image is formed on the photosensitive drum 50.

On the other hand, in synchronization with the toner image formation operation onto the photosensitive drum 50, the pickup roller 43 and the separate roller 44 are driven at any of the paper feed cassettes 13*a* to 13*c*, and the supply of specified paper sheets P is started from any of the paper feed cassettes 13*a* to 13*c*. When one of these paper sheets P goes to the developed image forming portion 14, it is guided vertically by the guide 63, and made to go through the transfer roller 61, and its end is rearranged by the resist roller 62, and then sent to the transfer conveyor belt 56, and a toner image formed on the photosensitive drum 50 is transferred onto it.

After then, the paper sheet P is absorbed electrostatically by the transfer conveyor belt 56, and is conveyed in the direction of the fixation roller coupling 64, and toner image is fixed onto it, then the paper sheet P is made to go through the paper discharge roller coupling 66 and the adjusting guide 67, and then output to the first transfer direction change portion 16.

Figure 10:
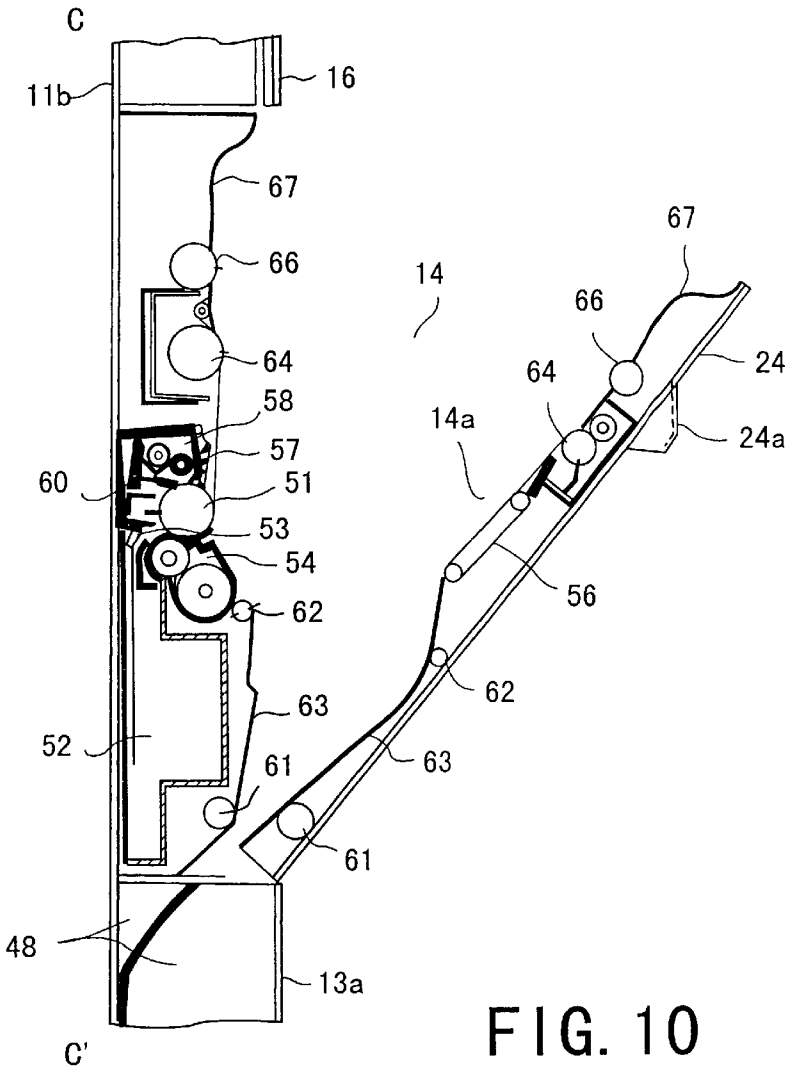
FIG. 10 is a schematic explanatory diagram showing a cross section of a frontal side unit of a developed image forming portion according to one preferred embodiment of the present invention shown in FIG. 9, opened to the frontal side of a partition.
Figure 9:
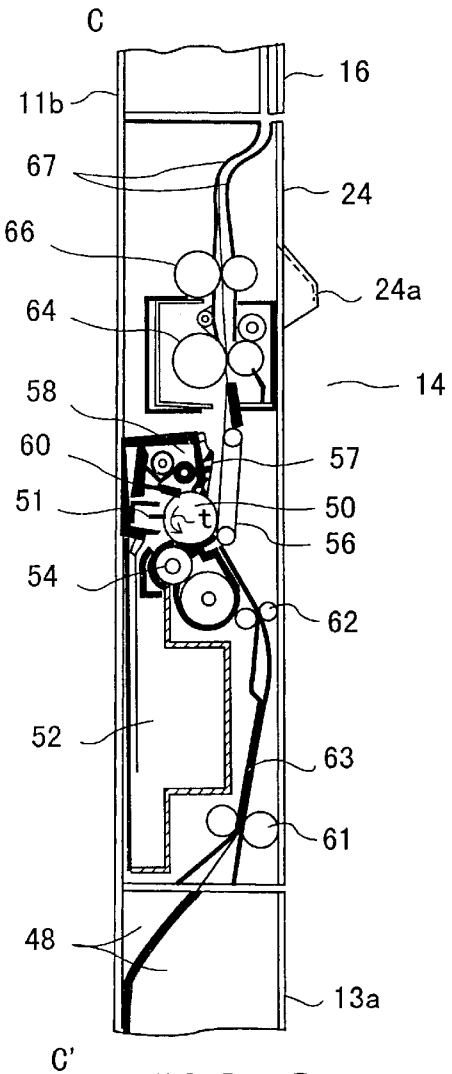
FIG. 9 is a schematic cross section of a developed image forming portion according to one preferred embodiment of the present invention, viewed at the line C–C' in FIG. 8.
Figure 12:
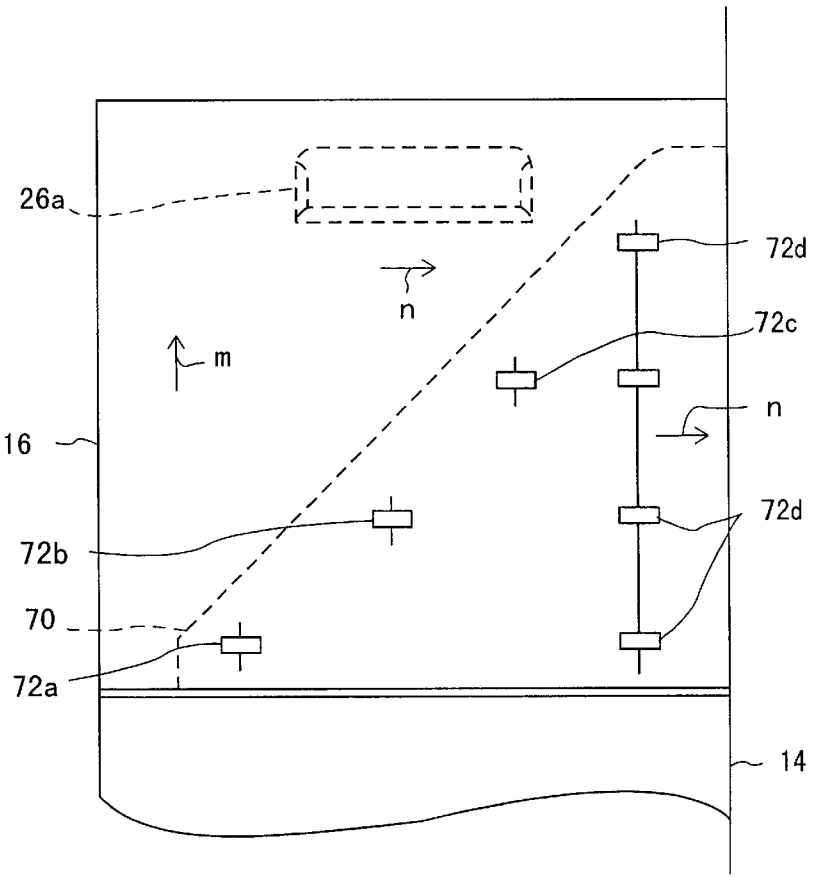
FIG. 12 is a schematic view of the back side of a first transfer direction changing portion according to one preferred embodiment of the present invention, viewed transparently from its frontal side.
Figure 11:
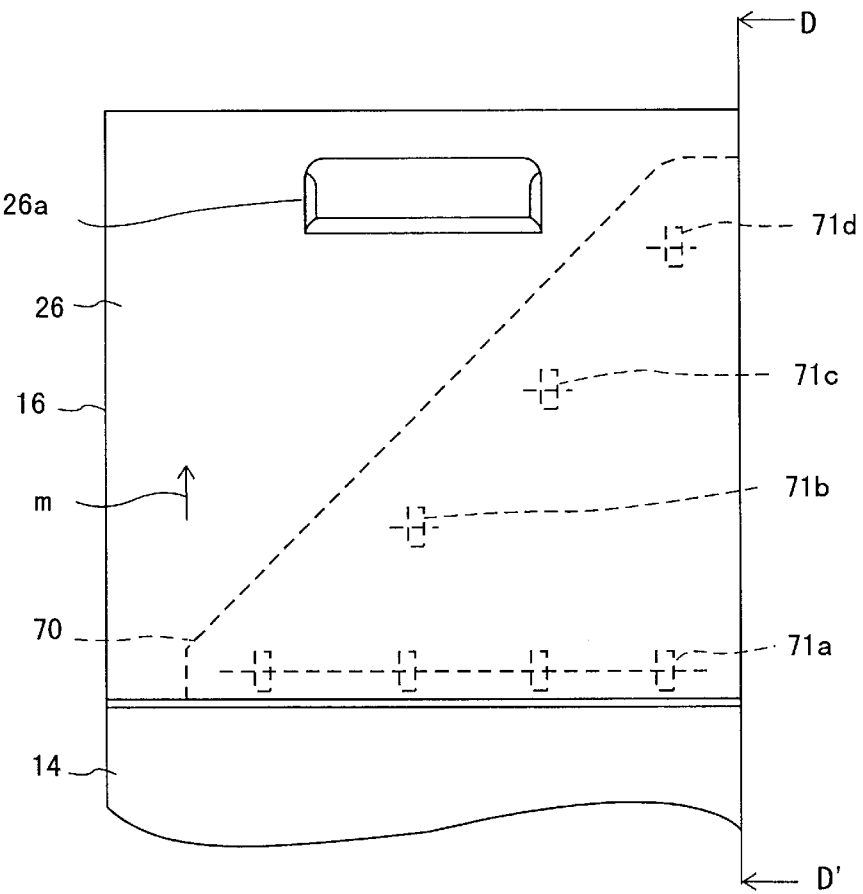
FIG. 11 is a schematic frontal view of a first transfer direction changing portion according to one preferred embodiment of the present invention.
Figure 16:
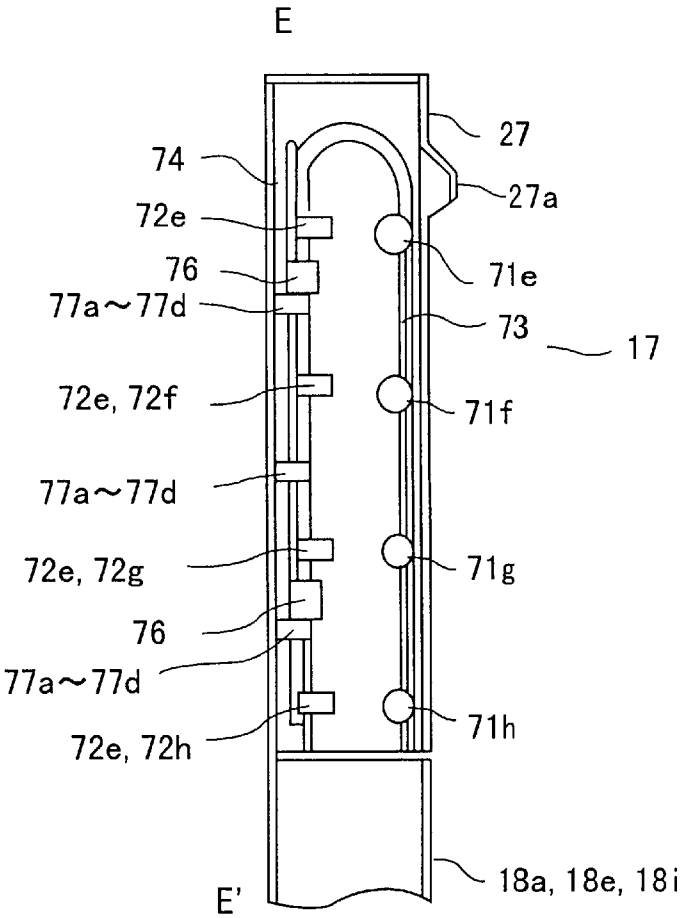
FIG. 16 is a schematic cross section of a first or third reversing portion according to one preferred embodiment of the present invention, viewed at the line E–E' in FIG. 14.
Figure 13:
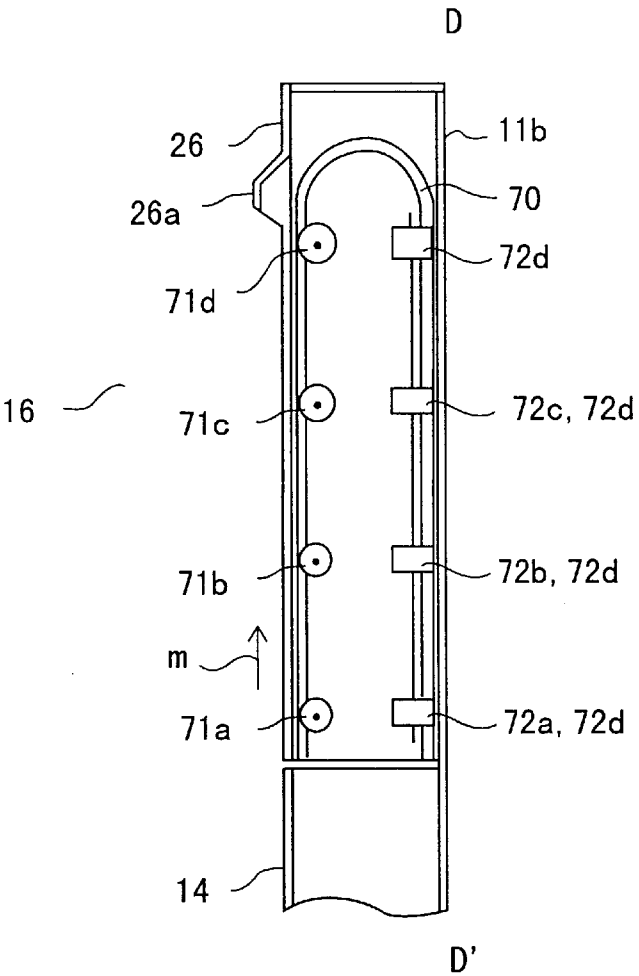
FIG. 13 is a schematic cross section of a first transfer direction changing portion according to one preferred embodiment of the present invention, viewed at the line D–D' in FIG. 11.
Figure 15:
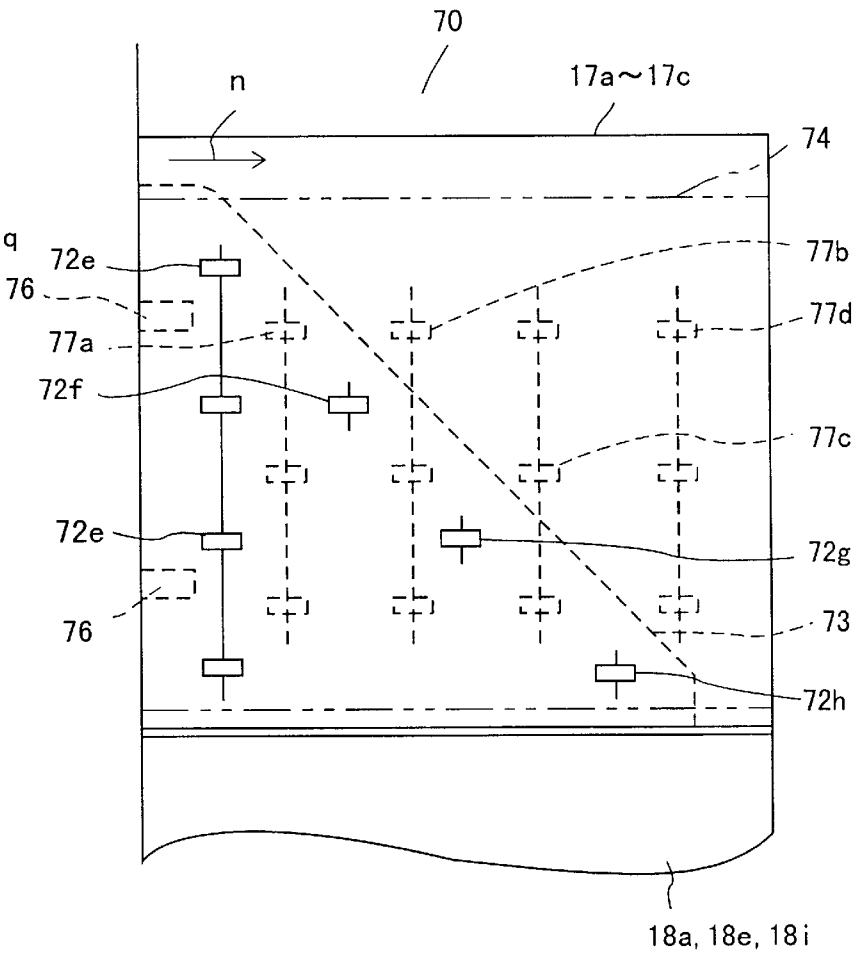
FIG. 15 is a schematic view of the back side of a first or third reversing portion according to one preferred embodiment of the present invention, viewed transparently from its frontal side.
Figure 14:
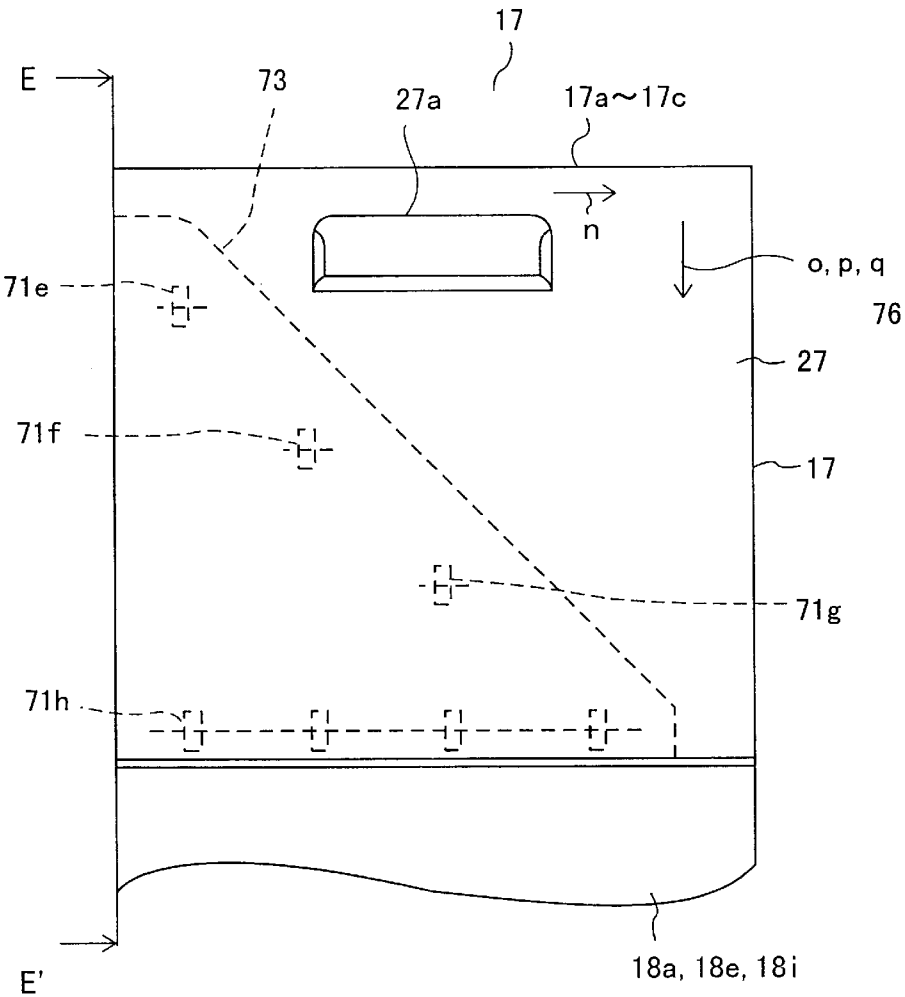
FIG. 14 is a schematic frontal view of a first or third reversing portion according to one preferred embodiment of the present invention.
Figure 17:
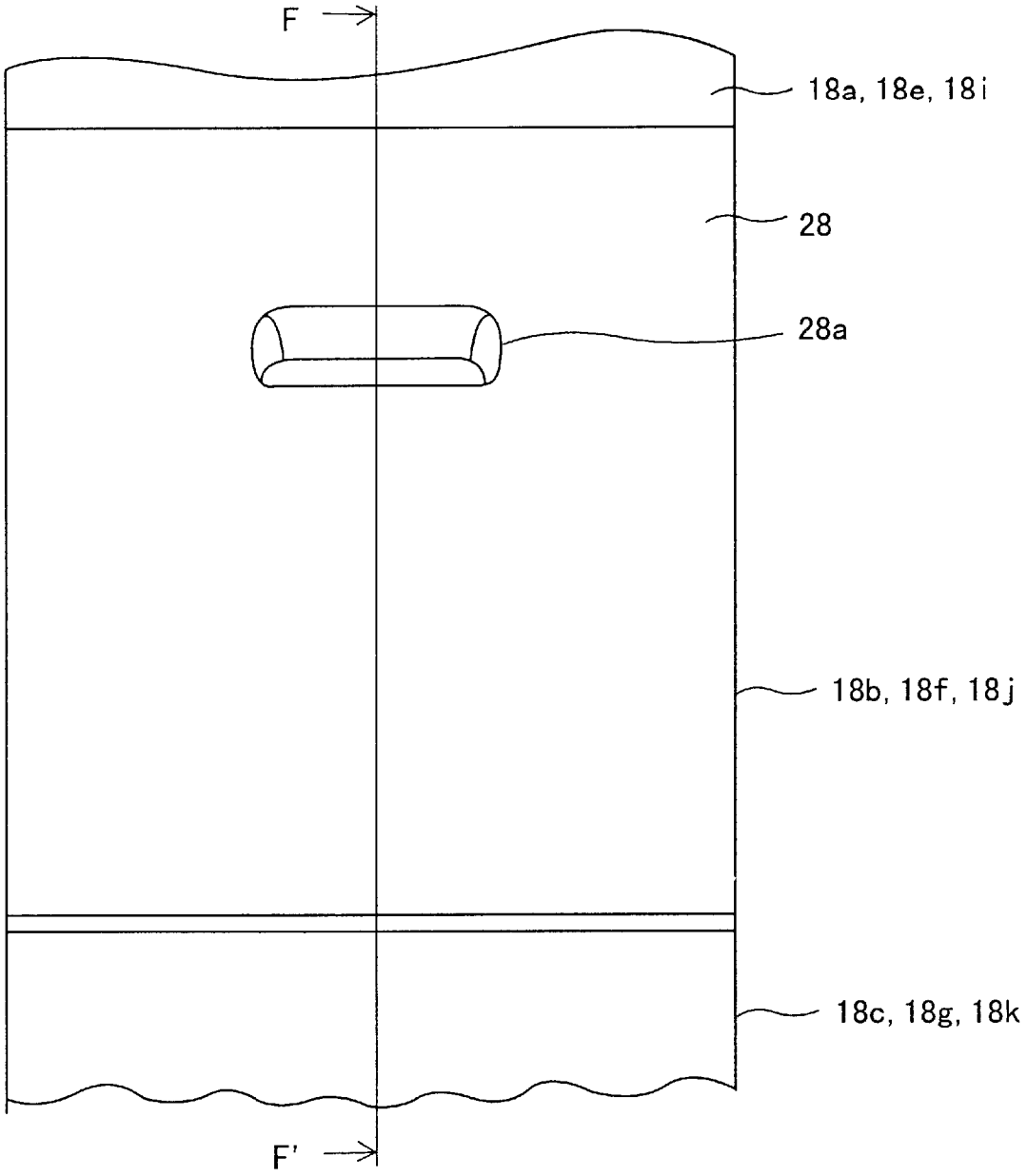
FIG. 17 is a schematic frontal view of a sorter according to one preferred embodiment of the present invention.
Figure 19:
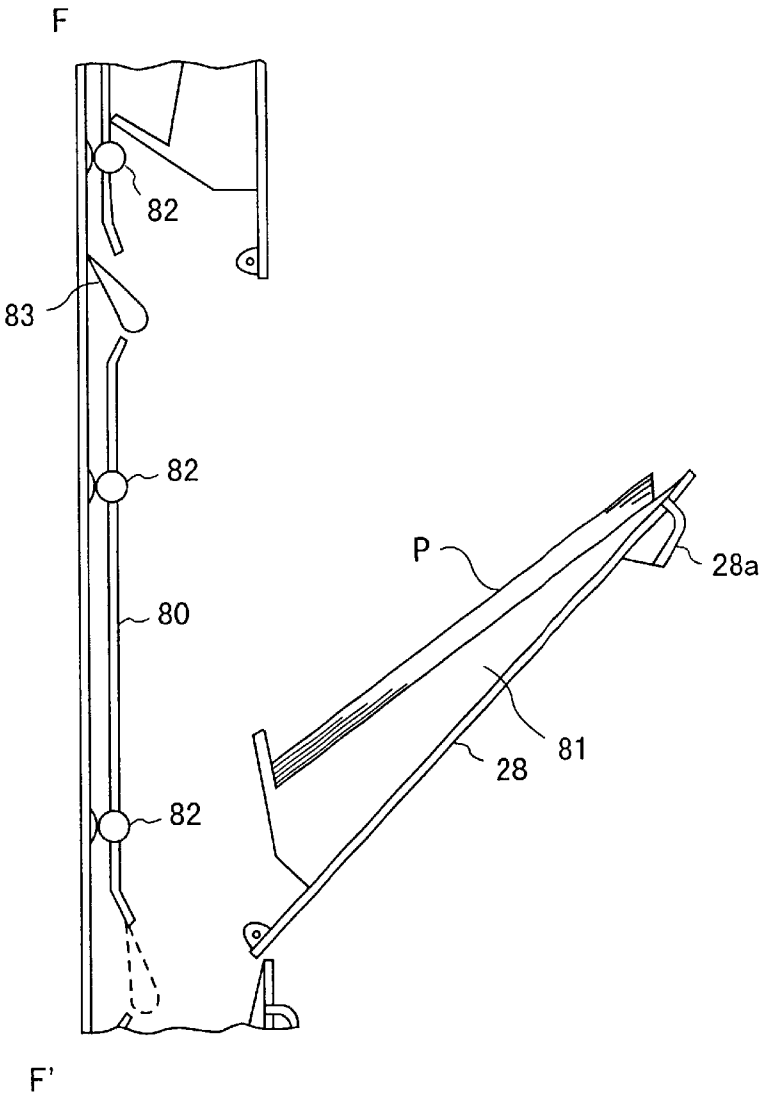
FIG. 19 is a schematic explanatory diagram showing a cross section of a sorter according to one preferred embodiment of the present invention shown in FIG. 18, opened to the frontal side of a partition.

By the way, at maintenance work such as to remove clogged paper sheets or so, as shown in FIG. 10, the knob 24 a is pulled, and so as to release the paper sheet route of the developed image forming portion 14, the front side unit 14*a* incorporated with the cover 24 is turned, thereby maintenance such as to remove clogged paper sheets or so is carried out. After completion of maintenance work, the cover 24 is reset so that it should be flat with the front side of the second partition 11*b*.

The first transfer direction change portion 16 and the first to third reverse portions 17*a* to 17*c* are for changing the transfer direction of paper sheets P by 90 degrees, and after paper sheets P are discharged from the developed image forming portion 14, and made to go through any of the first transfer direction change portion 16 and the first to third reverse portions 17*a* to 17*c*, the transfer direction of paper sheets P is changed by 180 degrees.

The first transfer direction change portion 16 has a first change guide 70 that is inclined by 45 degrees to the arrow direction m as the output direction of the paper sheets P of the developed image forming portion 14. In the front side of the first change guide 70, arranged are a first to fourth front rollers 71*a* to 71*d* that convey the paper sheets P in the arrow direction m along the first change guide 70. While in the rear side of the first change guide 70, arranged are a first to fourth rear rollers 72*a* to 72*d* that convey the paper sheets P in the arrow direction n along the first change guide 70.

When a paper sheet P having a developed image is output from the developed image forming portion 14, the first front roller 71*a* is driven, and further in accordance with the size of the paper sheet P concerned, the second to fourth front roller 71*b* to 71*d* are driven, and the paper sheet P is conveyed through the first change guide 70, and its transfer direction is changed by 90 degrees in the arrow direction n as the first reverse portion 17*a* direction along the inclination of the first change guide 70, and the paper sheet is discharged in the first reverse portion 17*a* direction.

By the way, in the case of paper clogging, the knob 26*a* is pulled, and the first transfer direction change portion 16 is turned to the front side of the second partition 11*b*, and paper is removed, and after then, the first transfer direction change portion 16 is reset so that it should be flat with the front side of the second partition 11*b*.

The first to third reverse portions 17*a* to 17*c* have a second change guide 73 that is inclined by 45 degrees to the arrow direction n as the output direction of the paper sheets P of the first transfer direction change portion 16, and a pass guide 74 that passes paper sheets P in the direction of the rear reverse portions 17*b* and 17*c*. At the paper sheets P take-in position from the first transfer direction change portion 16 of respective reverse portions 17*a* to 17*c*, arranged is a gate 76 that switches whether to take in paper sheets P in the second change guide 73 direction, or pass paper sheets P in the pass guide 74 direction.

In the rear side of the second change guide 73, arranged are a fifth to eighth rear rollers 72*e* to 72*h* that convey the paper sheets P in the arrow direction n along the second change guide 73. While in the front side of the second change guide 73, arranged are a fifth to eighth front rollers 71*e* to 71*h* that convey the paper sheets P in the arrow direction o, the arrow direction p or the arrow direction q along the second change guide 73. And to the pass guide 74, arranged are a first to fourth pass roller 77*a* to 77*d* that convey paper sheets P in the arrow direction n along the pass guide 74.

At conveyance of paper sheets P, a paper sheet P output from the first transfer direction change portion 16 in the arrow direction n is sorted whether to the second change guide 73 direction or the pass guide 74 direction by the gate 76 at the reverse portion 17*a*. When the paper sheet P is sorted to the second change guide 73 direction by the gate 76, the paper sheet P is conveyed through the second change guide 73 in the arrow direction n by the fifth to eighth rear rollers 72*e* to 72*h*, and its direction is changed by 90 degrees in the arrow direction o along the inclination of the second change guide 73, and the paper sheet is output in the first sorter 18*a* direction.

When the paper sheet P is sorted to the pass guide 74 direction by the gate 76, the paper sheet P is conveyed through the pass guide 74 in the arrow direction n by the first to fourth pass rollers 77*a* to 77*d*, and is discharged in the second reverse portion 17*b* direction.

The paper sheet P that has reached at the second reverse portion 17*b* is sorted whether to the second change guide 73 direction or the pass guide 74 direction by the gate 76 as same as at the first reverse portion 17*a*, and its transfer direction is converted by the second change guide 73, and the paper sheet is output to the fifth sorter 18*e* direction, or made to go up to the third reverse portion 17*c* by the pass guide 74.

The paper sheet P that has reached at the third reverse portion 17*c* is sorted to the second change guide 73 direction by the gate 76, and is output in the ninth sorter 18*i* direction.

By the way, at the event of paper clogging of the paper sheets P at the first to third reverse portions 17*a* to 17*c*, the knob 27*a* of any of the reverse portions 17*a* to 17*c* concerned is pulled, and the reverse portions 17*a* to 17*c* are turned to the front side of the second or third partition 11*b* or 11*c*, and paper sheet P is removed, and the reverse portions 17*a* to 17*c* are reset so that they should be flat with the front side of the second or third partition 11*b* or 11*c*.

In the next place, respective sorter 18*a* to 18*l* have a transfer guide 80, and a sorter bin 81 that collects paper sheets P vertically. The transfer guide 80 is equipped with a transfer roller 82. At the entrance end of the sorter bin 81, arranged is a gate 83 that switches whether to take in paper sheets P in the sorter bin 81 direction, or pass paper sheets P in the pass guide 80 direction so as to pass it in the sorter 18 direction at the downstream side.

Respective sorters 18*a* to 18*l* are specified to respective users, and the cover 28 is equipped with a key 28 *b* so that only a specified user can use his own specified sorter.

Sorting of paper sheets P is conducted so that paper sheets P are collected to a specially selected sorter 18 that is designated at developed image formation. Namely, in the case of facsimile image information, and addressee transmission number is input at sending image information, and thereby a sorter 18 to collect paper sheets P is specified. And in the case of output image information from a computer, automatically according to a computer to be used, or by designating a sorter bin 81 at outputting image information, sorter 18 to collect paper sheets P is specified. By the way, in the case of document image information read by the document reading portion 12, for example, the key 28*b* is unlocked at the first sorter 18*a*, and this first sorter 18*a* may be made a freely available common sorter, and paper sheets P may be output thereto.

Figure 18:
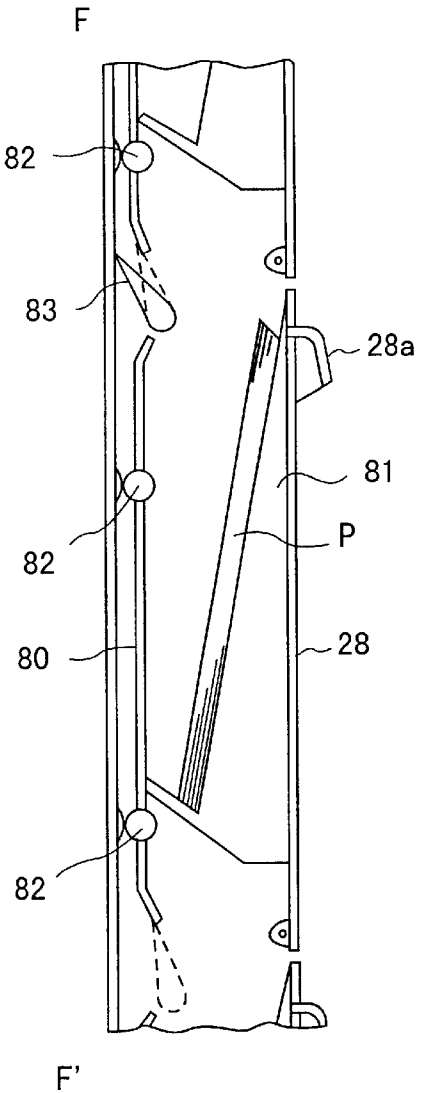
FIG. 18 is a schematic cross section of a sorter according to one preferred embodiment of the present invention, viewed at the line F–F' in FIG. 17.

At sorting of paper sheets P, if for example the second sorter 18*b* is the specified sorter, the gate 83 is displaced in a direction to close the transfer guide 80 as shown in the continuous line in FIG, 18 so that paper sheets P discharged from the reverse portion 17*a* to 17*c* should be taken in by the second sorter 18*b*. As for other sorter 18 than the second sorter 18*b*, the gate 83 is displaced in a direction to close the sorter bin 80 side as shown in dot line in FIG. 18 so that paper sheets P should be passed in the transfer guide 80 direction.

After completion of developed image formation, an operator releases for example the key 28*b* of the second sorter 18*b*, pulls the knob 28*a*, and turns the second sorter 18*b* to the front side of the second partition 11*b*, and takes out output paper sheets P. And an operator resets the second sorter 18*b* so that it should be flat with the front side of the second partition 11*b*, and then locks the key 28*b*.

Now hereafter actions are described. When to copy a document image, an operator sets a document G at the paper feed side of the first transfer guide 30 of the document reading portion 12. Thereby, when the paper feed sensor 35 of the document reading portion 12 detects the document G, MFP 10 starts copied image forming operation according to document image information. Namely, the document reading portion 12 conveys the document G in the arrow direction s along the second to fourth transfer guides 31 to 33, and discharges the document to the paper discharge tray 22*b*. At this moment, the reading sensor 40 reads the reflected light from the document G by the radiation device 38 as image information, and inputs the document image information to the exposure device 52 of the developed image forming portion 14. The developed image forming portion 14 turns the photosensitive drum 50 in the arrow t direction by the document image information input into the exposure device 52, and thereby starts developed image forming operation. While the photosensitive drum 50 turns in the arrow t direction, through electrification operation, exposure operation and development operation, a toner image is formed according to the document image information.

While a toner image is formed on the photosensitive drum 50, at the paper feed cassettes 13*a* to 13*c*, paper sheets P of a specified size are taken out by the pickup roller 43 and the separate roller 44, and fed to the resist roller 62 through the transfer roller 61 of the developed image forming portion 14. The paper sheets P that have reached to the resist roller 62 are supplied to the transfer conveyor belt 56 position in synchronization of the toner image on the photosensitive drum 50, and are transferred the toner image on the photosensitive drum 50.

After then, the toner image is are heated, pressed and fixed onto the paper sheets P by the fixation roller coupling 64, and developed images are completed thereon, and the paper sheets P are output via the paper discharge roller coupling 66, the adjusting guide 67 to the first transfer direction change portion 16. On the other hand, the photosensitive drum 50 after the toner image is transferred continues rolling, and remaining toner and paper powder are cleaned by the cleaning device 58, and electric potential on the surface of the photosensitive drum 50 is removed by the electricity removing lamp 60, and the next developed image forming process is awaited.

The paper sheets P output from the developed image forming portion 14 are collected to a specified sorter 18, however in the case of image formation by document image from the document reading portion 12, the key 28*b* is unlocked, so the paper sheets are collected to the freely available common first sorter 18*a*.

Therefore, the paper sheets P discharged from the developed image forming portion 14 are made to go through the first change guide 70 of the first transfer direction change portion 16, and the transfer direction is changed from the arrow m direction to the arrow n direction by 90 degrees, and the paper sheets are sorted into the second change guide 73 direction by the gate 76 of the first reverse portion 17*a*, and the transfer direction is further changed by 90 degrees along the inclination of the second change guide 73 from the arrow n direction to the arrow o direction.

During this moment, at the first to fourth sorters 18*a* to 18*d* positioned at the downstream side of the reverse portion 17*a*, the gate 83 of the first sorter 18*a* is controlled so as to be displaced to close the transfer guide 80 so as to take the paper sheets P into the sorter bin 81, and the paper sheets P whose direction has been changed into the arrow o direction by the first reverse portion 17*a* are taken in by the first sorter 18*a*, and collected into the sorter bin 81. After this, an operator takes out the paper sheets P on which document image is output from the sorter bin 81 of the first sorter 18*a*, and further takes out the document G on the paper discharge tray 22 of the document reading portion 12, and gets developed image by copying function.

In the next place, in the case of image formation of image information sent via facsimile on communication line, by the sending operation of facsimile image information, a user of MFP 10 is automatically designated, and the collection address of the paper sheets P after image formation is designated, for example, as the tenth sorter 18*j*.

At receipt of facsimile image information, MFP 10 starts facsimile image forming operation, and inputs facsimile image information to the exposure device 52 of the developed image forming portion 14. After then, MFP 10 forms developed image onto the paper sheets P supplied from the paper feed cassettes 13*a* to 13*c* at the developed image forming portion 14, in the same manner as in the document image information formation, and outputs paper sheets P to the first transfer direction change portion 16 direction.

Paper sheets P output from the developed image forming portion 14, so as to be collected into the specified tenth sorter 18*j*, are made to go through the first change guide 70 of the first transfer direction change portion 16, and the transfer direction is changed by 90 degrees from the arrow m direction to the arrow n direction, and paper sheets are sorted to the pass guide 74 direction by the gate 76 of the first reverse portion 17*a*, and reach to the second reverse portion 17*b*. Further, the paper sheets P are sorted to the pass guide 74 direction by the gate 76 of the second reverse portion 17*b* and reach to the third reverse portion 17*c*, and the transfer direction is changed by 90 degrees from the arrow n direction to the arrow q direction along the inclination of the second change guide 73 of this third reverse portion 17*c*.

During this process, at the ninth to twelfth sorters 18*i* to 18*l* positioned in the downstream side of the third reverse portion 17*c*, the gate 83 of the tenth sorter 18*j* is controlled to be displaced to close the transfer guide 80 so that paper sheets P should be taken in the sorter bin 81 by the gate 83 of the tenth sorter 18*j*. On the other hand, the gate 83 of other sorters 18*i*, 18*k*, and 18*l* is controlled to be displaced to release the transfer guide 80 and close the sorter bin 81.

Accordingly, the paper sheets P whose direction has been changed to the arrow q direction by the third reverse portion 17*c* are taken into the tenth sorter 18*j*, and collected into the sorter bin 81. After then, a user who has received facsimile information releases the key 28*b* of the tenth sorter 18*j*, and take out the output paper sheets P having facsimile image information. After taking out paper sheets P, user locks the key 28*b* of the tenth sorter 18*j* once again, and gets developed image by facsimile function.

In the next place, in the case of image formation of computer output image information, a user of MFP 10 is automatically designated per computer to be used and registered, and the collection address of the paper sheets P after image formation is designated automatically. While, the collection address of the paper sheets P after image formation may be designated by designating a sorter 18 through a keyboard or so to a computer.

When output image information is input from a computer to be used and registered, without designation of collection address of the paper sheets P. MFP 10 specifies a user, and automatically designates the collection address of the paper sheets P to, for example, the tenth sorter 18*j*. Then, MFP 10 starts its image forming operation as a printer, and inputs image information output from computer to the exposure device 52 of the developed image forming portion 14. After then, MFP 10 forms developed image onto the paper sheets P supplied from the paper feed cassettes 13*a* to 13*c* at the developed image forming portion 14, in the same manner as in the document image information formation, and outputs paper sheets P to the first transfer direction change portion 16 direction.

Paper sheets P output from the developed image forming portion 14 are collected into the sorter bin 81 of the specified tenth sorter 18*j*, in the same manner as in the facsimile image information formation. Accordingly, user releases the key 28*b* of the tenth sorter 18*j*, and take out the output paper sheets P having computer output image information, and gets developed image by printer function.

In MFP 10 as configured as mentioned heretofore, making the most of plane shaped second and third partitions 11*b* and 11*c* to be used a partitions in office, the second and third partitions 11*b* and 11*c* are installed therein, even though it is equipped with the sorter 18, there is no need for wide installation space exclusive for MFP 10, consequently, it is possible to save space to a great extent.

And, since the sorter 18 to collect the paper sheets P output after image formation is designated in advance for users, though plural users use it in common at multifunctional image formation, a specific user can obtain his output paper sheets P without confusion with paper sheets output for other users, thus it is possible to remarkably improve users' convenience.

By the way, the present invention may be embodied in other specific forms without departing from the spirit or essential characteristics thereof, for example, MFP may not always be equipped with a document reading device, and sizes of paper sheets and so forth are not limited. And so far as paper sheets are held vertically, their feed direction or output direction may be optional longitudinally or laterally or so. Moreover, the number of paper feed cassettes to be incorporated in panel, and the number of sorters may be optionally decided at necessity, so in the case where many paper feed cassettes and sorters are needed, the number of panels to which these are to be incorporated may be increased.

Figure 20:
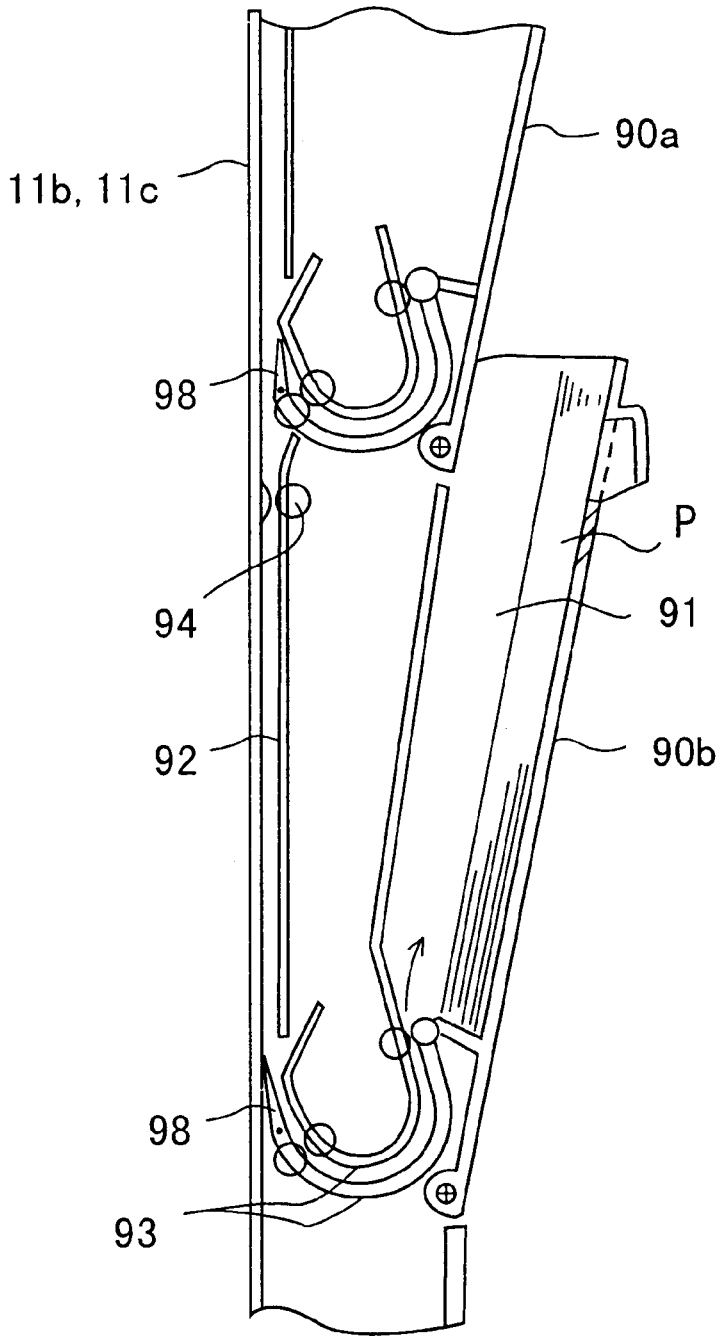
FIG. 20 is a schematic explanatory diagram showing a cross section of a sorter as a first modified example according to one preferred embodiment of the present invention, attached to a partition.
Figure 21:
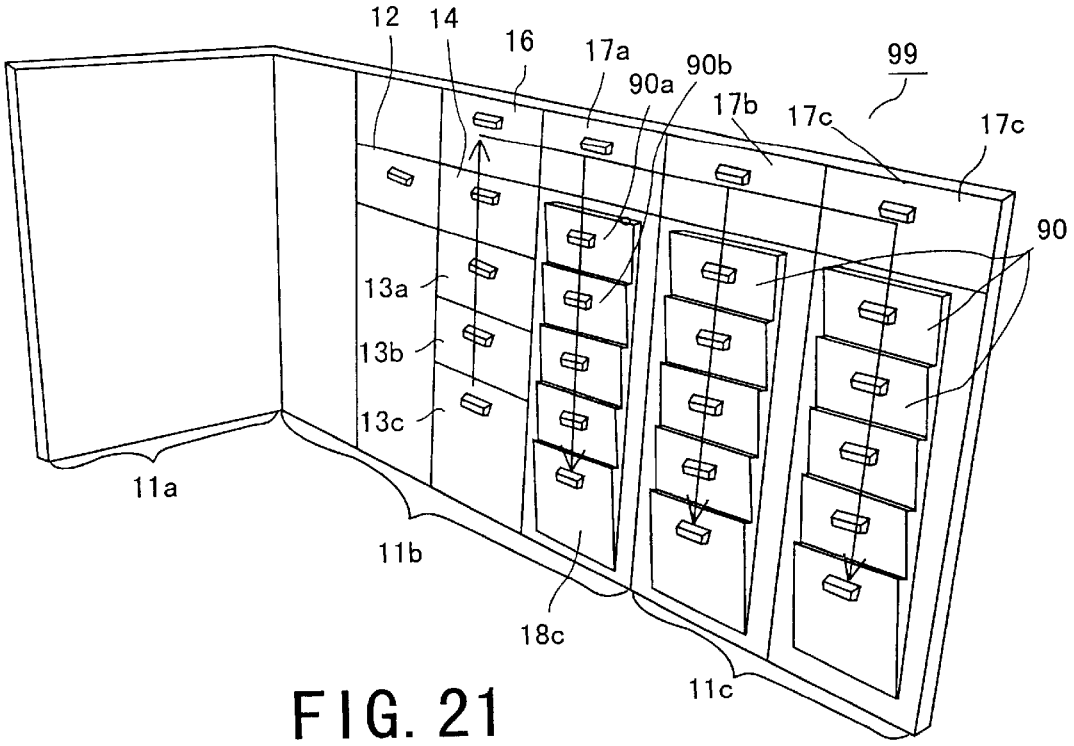
FIG. 21 is a schematic diagonal view of an MFP as a first modified example according to one preferred embodiment of the present invention.

Further, the shape, change method and so forth of the transfer direction change portion for changing paper sheet transfer directions in flat type panels are not limited, and as for sorters too, in order to assemble more sorters in a single panel, as shown in the first modified example in FIG. 20 and FIG. 21, sorters 90*a* and 90*b* that are adjacent to each other vertically may be arranged so that part of them pile up to each other. These sorters 90*a* and 90*b* have a reverse guide 93 for reversing paper sheets P that are taken into the sorter bin 91 side by the gate 98 after they pass the transfer guide 92 so that paper sheets P are smoothly collected vertically into the sorter bin 91.

In addition, the transfer guide 92 is equipped with a transfer roller 94, and inside of the reverse guide 93, arranged are a take-in roller 96, and a discharge roller 97. The gate 98 is arranged at the entrance end of the reverse guide 93, and switches whether to take the paper sheets P into the reverse guide 93 side, or to pass them to the sorter 90 direction at the downstream side. As a result, in this first modified example MFP 99, as shown in FIG. 21, it is possible to incorporate more sorters 90 into the second and third partitions 11*b* and 11*c* than in the case of the sorters 18 in the mentioned embodiments.

Figure 22:
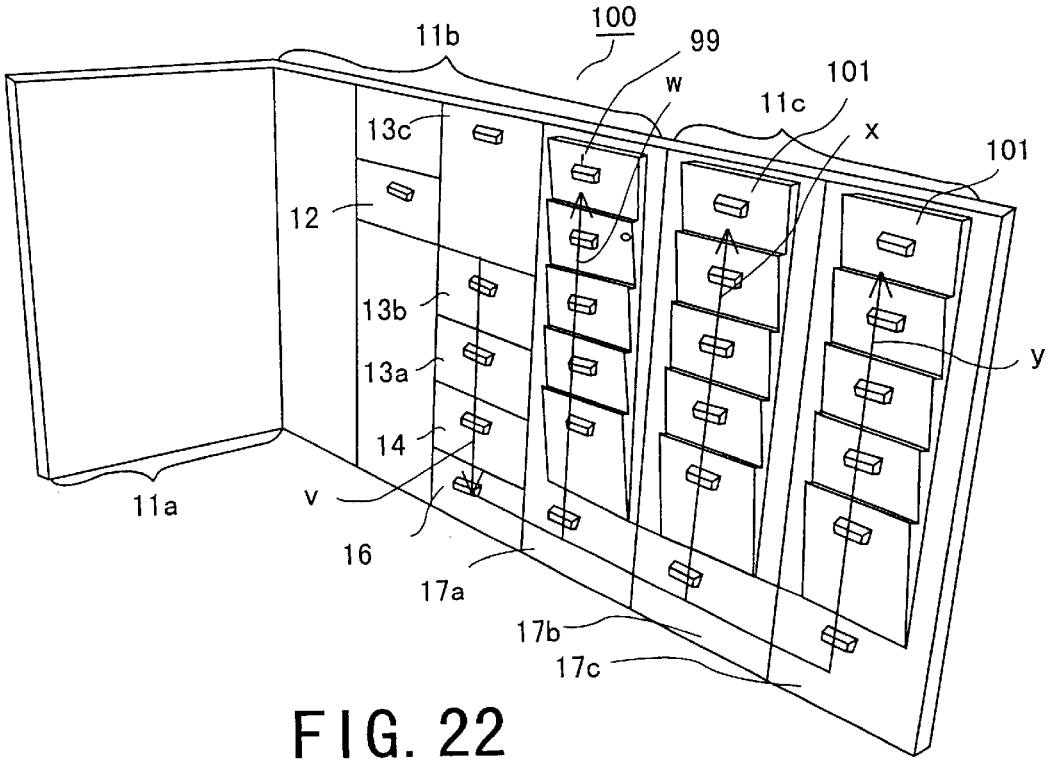
FIG. 22 is a schematic diagonal view of an MFP as a second modified example according to one preferred embodiment of the present invention.

And further, the transfer method of paper sheets on panel of MFP to be assembled into panel is optional, for example, as MFP 100 of a second modified example shown in FIG. 22, in the second partition 11*b*, the developed image forming portion 14 may be arranged in the downstream side of paper feed cassettes 13*a* to 13*c*, and paper sheets P may be transferred in the arrow v direction and thereby developed image formation may be carried out, still further, at output, paper sheets P may be transferred in the arrow w direction, x direction or y direction, and be collected into a sorter 101.

As mentioned heretofore, according to the present invention, by making the most of wide flat surface of partitions used as space separating panels in offices and so forth, and by assembling a multifunctional image forming apparatus having sorters into flat planes of partitions, there is no need for wide space exclusively for installation of such an image forming apparatus as in prior art, consequently it is possible to save space in offices.

And, since the sorters for users to use are designated in advance for respective users, even though an image forming apparatus has multiple functions as a copier, facsimile, printer and so forth, and is used in common by plural users, a specific user can obtain his output paper sheets without confusion with paper sheets output for other users, thus it is possible to remarkably improve users' convenience.

The embodiments shown above are to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An image forming apparatus comprising:

a holder configured to hold a record medium vertically;

a feeder configured to feed the record medium in the holder to image forming direction in a vertically held status;

a printer configured to form a developed image onto the record medium in accordance with image information while the record medium fed from the holder goes through in vertically held status;

a sorter configured to sort the record media discharged from the printer for respective users and collect the record media vertically into plural sorter bins; and a frame configured to incorporate at least the holder, the printer, and the sorter into one body in vertically flat shape.

2. An image forming apparatus set forth in claim 1 further comprising:

a transfer direction changer configured to change the transfer direction of the record medium between the holder and the printer, and/or between the printer and the sorter.

3. An image forming apparatus set forth in claim 2, wherein the transfer direction changer changes the transfer direction of the record medium by 180 degrees, by a first transfer direction changer that changes the transfer direction of the record medium by 90 degrees vertically while holding the record medium vertically, and a second transfer direction changer that changes the transfer direction of the record medium further by 90 degrees vertically while holding the record medium discharged from the first transfer direction changer.

4. An image forming apparatus set forth in claim 1 further comprising a scanner configured to read directly a document having the image information, the scanner being assembled in the frame.

5. An image forming apparatus set forth in claim 4, wherein the printer forms an image in accordance with the image information from the scanner, or the image information from communication line, or the image information output from a computer.

6. An image forming apparatus set forth in claim 1, wherein the frame is arranged vertically in a space, and functions as partition means to separate the space.

7. An image forming apparatus set forth in claim 1, wherein the frame is configured by connecting adjacent plural parts.

8. An image forming apparatus set forth in claim 1, wherein the sorter bin can be opened and closed to the front side of the frame, and further includes security means for allowing only the specified user can open and close the sorter bin.

9. An image forming apparatus set forth in claim 1, wherein the sorter bin is assembled into the frame so that part adjacent to the transfer direction of the record medium piles to each other.

10. An image forming apparatus set forth in claim 3, wherein the frame is arranged vertically in a space and functions also as a partition means to separate the space at necessity;

a scanner is further assembled into the frame, for reading a document having the image information by the printer; and the printer forms an image in accordance with the image information from the scanner, or the image information from communication line, or the image information output from a computer.

11. An image forming apparatus comprising:

a paper feed cassette configured to hold a record medium vertically;

a paper feed roller configured to feed the record medium in the paper feed cassette to image forming direction in a vertically held status;

a developed image forming portion configured to form a developed image onto the record medium in accordance with image information while the record medium fed from the paper feed cassette goes through in vertically held status;

a sorter configured to sort the record media discharged from the developed image forming portion for respective users and collect the record media vertically into plural sorter bins; and a panel configured to incorporate at least the paper feed cassette, the developed image forming portion, and the sorter into one body in vertically flat shape.

12. An image forming apparatus set forth in claim 11 further comprising:

a transfer direction change portion assembled in the panel, configured to change the transfer direction of the record medium between the paper feed cassette and the developed image forming portion, and/or between the developed image forming portion and the sorter.

13. An image forming apparatus set forth in claim 12, wherein the transfer direction change portion changes the transfer direction of the record medium by 180 degrees, by a first transfer direction change portion that changes the transfer direction of the record medium by 90 degrees vertically while holding the record medium vertically, and a second transfer direction change portion that changes the transfer direction of the record medium further by 90 degrees vertically while holding the record medium discharged from the first transfer direction change portion.

14. An image forming apparatus set forth in claim 11 further comprising a scanner configured to read directly a document having the image information, the scanner being assembled in the panel.

15. An image forming apparatus set forth in claim 14, wherein the developed image forming portion forms an image in accordance with the image information from the document reading portion, or the image information from communication line, or the image information output from a computer.

16. An image forming apparatus set forth in claim 11, wherein the panel is arranged vertically in a space, and functions as an partition to separate the space.

17. An image forming apparatus set forth in claim 11, wherein the panel is configured by connecting adjacent plural parts.

18. An image forming apparatus set forth in claim 11, wherein the sorter bin can be opened and closed to the front side of the panel, and further has a key that allows only the specified user can open and close the sorter bin.

19. An image forming apparatus set forth in claim 11, wherein the sorter bin is assembled into the panel so that part adjacent to the transfer direction of the record medium piles to each other.

20. An image forming apparatus set forth in claim 13, wherein the panel is arranged vertically in a space and functions also as a partition to separate the space at necessity;

a document reading portion is further assembled into the panel, for reading a document having the image information by the developed image forming portion; and the developed image forming portion forms an image in accordance with the image information from the document reading portion, or the image information from communication line, or the image information output from a computer.

21. An image forming method comprising the steps of:

assembling a paper feed cassette configured to hold a record medium vertically, a developed image forming portion configured to form a developed image onto the record medium fed from the paper feed cassette in accordance with image information, and a sorter configured to sort the record media discharged from the developed image forming portion for respective users and collect the record media vertically into plural sorter bins into a flat panel as one body so that the discharge end of the record media should meet the input end of the record media;

forming the developed image onto the record media in a status where the record media are held vertically; and collecting the record media into the plural sorter bins for respective users.

22. An image forming method set forth in claim 21, wherein further a transfer direction change portion, that changes the transfer direction of the record medium between the paper feed cassette and the developed image forming portion, and/or between the developed image forming portion and the sorter, is assembled into the flat panel as a body so that the discharge end of the record media should meet the input end of the record media.

23. An image forming method set forth in claim 21, wherein further a document reading portion to read a document having the image information is assembled into the flat panel as a body.

24. An image forming method set forth in claim 23, wherein the developed image forming portion forms an image in accordance with the image information from the document reading portion, or the image information from communication line, or the image information output from a computer.

25. An image forming method set forth in claim 21, wherein the flat panel separates space wherein the flat panel is installed.

* * * * *